US008074425B2

(12) United States Patent
Hanson et al.

(10) Patent No.: US 8,074,425 B2
(45) Date of Patent: Dec. 13, 2011

(54) FOOD STORAGE BAG FACILITATION SYSTEM

(76) Inventors: Beverly J. Ballard Hanson, Marlborough, MA (US); Tim N. Tibbert, Marlborough, MA (US)

( * ) Notice: Subject to any disclaimer, the term of this patent is extended or adjusted under 35 U.S.C. 154(b) by 79 days.

(21) Appl. No.: 12/214,743

(22) Filed: Jun. 23, 2008

(65) Prior Publication Data

US 2009/0313951 A1 Dec. 24, 2009

(51) Int. Cl.
*B65B 67/02* (2006.01)

(52) U.S. Cl. ..... 53/284.7; 53/390; 53/469; 211/12; 206/223; 141/391; 248/99

(58) Field of Classification Search ..... 53/255, 53/284.7, 381.1, 384.1, 390, 459, 469; 206/409, 206/216, 223; 141/391; 248/99; 211/12, 211/43

See application file for complete search history.

(56) References Cited

U.S. PATENT DOCUMENTS

| | | | | | |
|---|---|---|---|---|---|
| 176,555 | A | * | 4/1876 | Scholfield | 248/99 |
| 791,472 | A | * | 6/1905 | Kaiser | 141/108 |
| 3,270,485 | A | * | 9/1966 | Knepper | 53/390 |
| 3,598,350 | A | * | 8/1971 | Kaufman | 248/97 |
| 3,614,042 | A | * | 10/1971 | Jensen | 248/97 |
| 3,983,914 | A | * | 10/1976 | Benson | 53/390 |
| 4,037,778 | A | * | 7/1977 | Boyle | 53/390 |
| 4,201,029 | A | * | 5/1980 | Lerner et al. | 53/467 |
| 4,337,866 | A | * | 7/1982 | Suling et al. | 209/656 |
| 4,364,490 | A | * | 12/1982 | Lang et al. | 220/495.07 |
| 4,749,011 | A | * | 6/1988 | Rylander | 53/390 |
| 4,917,238 | A | * | 4/1990 | Schumacher | 206/223 |
| 4,979,547 | A | * | 12/1990 | Hoerner | 53/390 |
| D321,135 | S | * | 10/1991 | Bedell et al. | D9/434 |
| 5,080,253 | A | * | 1/1992 | Zieke | 383/63 |
| 5,129,609 | A | * | 7/1992 | Tobin | 248/99 |
| 5,170,957 | A | * | 12/1992 | Carpenter | 206/409 |
| 5,183,174 | A | * | 2/1993 | Quintero | 220/495.08 |
| D349,992 | S | * | 8/1994 | Brohan | D34/5 |
| 5,636,593 | A | * | 6/1997 | Vito | 119/165 |
| D384,273 | S | * | 9/1997 | Willis | D9/704 |
| 5,738,314 | A | * | 4/1998 | Davis | 248/97 |
| 5,772,046 | A | * | 6/1998 | Tercher et al. | 211/12 |
| 5,887,409 | A | * | 3/1999 | Leal Pereira Da Silva | 53/434 |
| 5,950,818 | A | * | 9/1999 | Paulsen | 206/409 |
| 6,007,030 | A | * | 12/1999 | Judge | 248/99 |
| D423,823 | S | * | 5/2000 | Nelson | D6/475 |
| 6,340,037 | B1 | * | 1/2002 | Stafford | 141/391 |
| 6,394,400 | B1 | * | 5/2002 | Sontag | 248/97 |
| 6,575,301 | B2 | * | 6/2003 | Simhaee | 206/554 |
| 6,651,942 | B1 | * | 11/2003 | Yardley et al. | 248/100 |
| 6,866,070 | B2 | * | 3/2005 | King et al. | 141/391 |
| D507,179 | S | * | 7/2005 | King et al. | D9/434 |
| 6,976,583 | B2 | * | 12/2005 | Horn | 206/395 |
| 7,021,026 | B2 | * | 4/2006 | Griggs et al. | 53/459 |
| 7,204,450 | B1 | * | 4/2007 | Mallory | 206/390 |
| 7,246,641 | B2 | * | 7/2007 | Blessman | 141/98 |
| 7,252,194 | B2 | * | 8/2007 | Tracy | 206/395 |
| 2009/0052809 | A1 | * | 2/2009 | Sampson | 383/38 |
| 2009/0279812 | A1 | * | 11/2009 | Blanchard | 383/119 |

* cited by examiner

*Primary Examiner* — Christopher Harmon

(57) ABSTRACT

A system for filling reclosable food storage bags comprising a packaging container containing a plurality of reclosable food storage bags and a frame for supporting and holding open the food storage bags during a filling procedure.

1 Claim, No Drawings

FOOD STORAGE BAG FACILITATION SYSTEM

BACKGROUND OF THE INVENTION

The inventors discovered this procedure when storing large bags of spaghetti sauce. With only two in the household, it was very hard to make a spaghetti sauce small enough. Because of this, and because it is as easy to make a large batch of sauce as it is to make a small batch, the inventors began making very large batches (large enough to fill 15 to 19 one gallon food storage bags with each bag holding enough for one pound of spaghetti). In the past, the inventors both had to help when filling the food storage bags—one would hold the bag open and the other would ladle the sauce into the bag. It was time consuming and took two people. It was worth the aggravation, however, as it was so convenient to just pull a bag of sauce out of the freezer when one did not feel like cooking and/or felt like spaghetti and the storage took so little room in the freezer. It is only necessary to soak the food storage bag with the frozen spaghetti sauce (or other food item with a liquid base) for a few minutes in hot water prior to heating it in a pan or the microwave for consumption. Trying to find an easier way to fill the bags, when one of the inventors was alone and the sauce was made and ready to bag, this inventor found that by emptying a Saltines' cracker box and pulling the edges of the zip lock bag over all four sides of the box by approximately one inch or more, the bag stayed secure and the inventor was able to fill it alone, and also remove the bag easily, seal it and store it.

Having now used the Saltines' box method many times for sauce and many other types of leftovers (with or without liquid) for the refrigerator or freezer (ie. beef stew, filling for chicken pot pie, sauces and gravies, leftover salads—potato, macaroni, fruit) and finding it very simple for one person to fill and store the bags in either the refrigerator or freezer, the inventors decided this idea should be patented.

Research has been done on patents already in existence that have tried to solve the problem of easily filling and storing food in food storage bags. There are quite a few patents, but it appears that all patents on record are separate devices made of different sized and shaped rods of either steel, plastic, nylon or a similar material. These rods are slippery, the shape is not square and it is necessary to pin the bags to the stand in order to hold them stationery when filling. The devices seem more complicated than necessary. These devices defeat the purpose of simplicity and one person cannot fill the bag, remove it and store it without a helping hand. One person could adjust the rods, attach the clips and fill the bag, but when any type of liquid is involved, another person would have to help when the clips were removed in order not to spill the contents. Also, solutions using these separate rod devices would be more expensive for the manufacturer of the bags or any other interested entity to provide than a simple square (or close to square) cardboard (or other non-slippery material) box as is the subject of this patent.

With this invention, food storage bags would be more competitive with plastic storage containers as they would take less space in the refrigerator or freezer when filled and much less room in the drawer or cabinet where they are stored prior to use. Also, one would not have to worry about staining as with plastic containers with covers because the bag would usually be thrown away after its use and not normally washed and stored in the cabinet. Food storage bags are also much less expensive and are usually disposed of after use.

BRIEF SUMMARY OF THE INVENTION

This invention is to facilitate the use of one-quart and one-gallon food storage bags by making them easier to fill with one person able to store foods of any type (liquids or solids) with little effort in the refrigerator or freezer. The inventors are simply recommending that a square cardboard (or other non-slippery material) box similar to the Saltines' cracker box (at least this gauge of cardboard being used or, even better, a heavier gauge of cardboard) noted in the background of the invention be used to hold the bags while filling.

BRIEF DESCRIPTION OF THE SEVERAL VIEWS OF THE DRAWING

[Not Applicable]

DETAILED DESCRIPTION OF THE INVENTION

The inventors are recommending and patenting the method of using a square (or nearly square) cardboard box (or a box of some material that is not slippery similar to cardboard) at least as thick as the Saltines Crackers box be used to secure the one-quart and one-gallon food storage bags when filling for storage. The bags do not slip off the box if pulled approximately 1" or more over all four edges of the box and one person can easily fill, remove, and seal the bag. If these boxes were provided, food storage bags would be so much easier to store food in than plastic containers and would virtually almost replace the use of plastic containers for a number of reasons. The food storage bags would be easy to fill and seal, easier to store before use, take much less room in the freezer or refrigerator, and stack well. Below are three suggestions for the manufacturers of food storage bags (or as noted in No. 3 below, any interested entity other than a food storage bag manufacturer) which would allow them to provide the boxes and help consumers find many more easy uses for their food storage bags.

1. The bags could be sold in a cardboard (or similar non-slippery material) box (using cardboard the approximate thickness of a Saltines' cracker box or thicker) that could be used to hold the bags while filling. Simply, pulling the top edges of the food storage bag over the four edges of the box, the bag stays open, stationary and is easily filled. For the one-gallon bag, the box would have to have an approximate end opening similar to the end opening of a Saltines' box (approximately 4¼"×4¼" square). The length of the box could be the same as the length of the box food storage bags are now sold in to accommodate the width of the food storage bags. Although the bottom of the bag would not touch the bottom of the box as the container would be deeper than the bag, it does not matter. The bag stays put without any problem because the bag fits snugly over the square end, the cardboard (or other material) is not slippery, and the bag does not fall in when filled as it does not fall in when using a Saltines' box. To use the outside box container, the consumer would have to remove all the bags from the container and either store them out of the container in a drawer or wherever or put all the bags in the container into one of the bags so that they could be easily removed to use the outer carton and then put back to store or the manufacturer could put the bags in another container of some sort within the outside carton for easy removal when using the outside container for filling. For the quart food storage bags, the size of the box end to be used and the depth of the packaging would be changed accordingly. This method would only require different outside packaging for both one-quart and one-gallon food storage bags and should be fairly inexpensive for the manufacturers of food storage bags. Of course, another container inside the outside carton containing the bags could also be provided by the manufacturers to make using the carton easier for the consumer.

2. A collapsible box the approximate size of the outside box above (except depth would be less to accommodate the depth of the food storage bag only) could be inserted in the outside packaging box along with the food storage bags so that the consumer could simply remove the collapsible box when ready to use and put it back in the outside container with the bags when not in use. This would require a different packaging box in order to accommodate the width of the collapsible box and the food storage bags. The collapsible box would have to have only one bottom end closure in order that the box would not fold when in use. A second top end would not be necessary. In this case, two boxes would have to be provided, but the collapsible box would serve the purpose very well.

3. Collapsible square cardboard (or other non-slippery material) boxes for both the one-gallon and one-quart food storage bags could be packaged and sold separately from the food storage bags. This could be offered by manufacturers of food storage bags or any other entity interested in manufacturing and marketing the product.

The invention claimed is:

1. A system for filling reclosable food storage bags comprising a packaging container containing a plurality of reclosable food storage bags and a frame for supporting and holding open the food storage bags during a filing procedure; wherein the frame comprises a collapsible box in a collapsed, empty condition sized to accommodate the mouth portion of the reclosable bags when placed in a filling position wherein the collapsible box in erected, a bag is placed inside the erected collapsible box, and the mouth portion of the reclosable bag is folded over the upper edge of the collapsible box.

* * * * *